US012274340B2

(12) United States Patent
Fereyre et al.

(10) Patent No.: US 12,274,340 B2
(45) Date of Patent: Apr. 15, 2025

(54) HAIR TREATMENT APPARATUS WITH STEAM CONTAINMENT

(71) Applicant: SEB S.A., Ecully (FR)

(72) Inventors: Régis Fereyre, Charly (FR); Johan Sabattier, Tassin la Demi Lune (FR); Mathias Ganem, Lyons (FR)

(73) Assignee: SEB S.A. (FR)

( * ) Notice: Subject to any disclaimer, the term of this patent is extended or adjusted under 35 U.S.C. 154(b) by 439 days.

(21) Appl. No.: 16/956,819

(22) PCT Filed: Dec. 21, 2018

(86) PCT No.: PCT/EP2018/086738
§ 371 (c)(1),
(2) Date: Jun. 22, 2020

(87) PCT Pub. No.: WO2019/122399
PCT Pub. Date: Jun. 27, 2019

(65) Prior Publication Data

US 2020/0397110 A1 Dec. 24, 2020

(30) Foreign Application Priority Data

Dec. 22, 2017 (FR) ..... 1763177

(51) Int. Cl.
*A45D 1/04* (2006.01)
*A45D 1/18* (2006.01)
(Continued)

(52) U.S. Cl.
CPC ..... *A45D 1/04* (2013.01); *A45D 1/18* (2013.01); *A45D 2001/008* (2013.01); *A45D 2/002* (2013.01)

(58) Field of Classification Search
CPC ..... A45D 1/04; A45D 1/14; A45D 1/18
See application file for complete search history.

(56) References Cited

U.S. PATENT DOCUMENTS 5,520,199 A 5/1996 Sturla
5,520,706 A 5/1996 Samain et al.
(Continued)

FOREIGN PATENT DOCUMENTS

EP 659393 A1 6/1995
EP 659395 A1 6/1995
(Continued)

OTHER PUBLICATIONS

International Search Report for Application No. PCT/EP2018/086738, mailed Feb. 28, 2019, pp. 1-2.

*Primary Examiner* — Rachel R Steitz
(74) *Attorney, Agent, or Firm* — Lerner David LLP

(57) ABSTRACT

The invention concerns a hair treatment apparatus, comprising: —two arms that are movable relative to each other and capable of assuming a spaced-apart configuration in which a lock of hair can be inserted between them, and a closed configuration for treating the lock of hair, the arms being capable of being moved along the lock in this closed configuration, —two contact surfaces carried respectively by the two arms, arranged opposite each other, at least one of the contact surfaces being heated, —at least one steam outlet carried by one of the arms at a distance from the corresponding contact surface, in order to expose the hair engaged between the arms to steam, —a containment structure for at least partially containing the steam, carried at least partially by the other of said arms, —a comb having teeth, carried by said one of the arms that carries said at least one steam outlet, said at least one steam outlet being interposed between the comb and the contact surfaces.

20 Claims, 6 Drawing Sheets

(51) Int. Cl.
*A45D 1/00* (2006.01)
*A45D 2/00* (2006.01)

(56) References Cited

U.S. PATENT DOCUMENTS

| | | | | |
|---|---|---|---|---|
| 5,551,453 | A | 9/1996 | Sturla | |
| 5,725,603 | A | 3/1998 | Audousset et al. | |
| 2004/0000319 | A1 | 1/2004 | Carballada et al. | |
| 2004/0045570 | A1 | 3/2004 | Yao | |
| 2006/0201527 | A1* | 9/2006 | Higgins | A45D 1/04 132/225 |
| 2008/0072921 | A1* | 3/2008 | Habibi | A45D 2/002 132/224 |
| 2012/0111356 | A1 | 5/2012 | Vacheron et al. | |
| 2015/0289620 | A1* | 10/2015 | Nuzzo | A45D 2/02 132/211 |
| 2015/0289622 | A1 | 10/2015 | Fereyre et al. | |
| 2015/0327650 | A1 | 11/2015 | Fereyre | |
| 2017/0135457 | A1 | 5/2017 | Ngo et al. | |

FOREIGN PATENT DOCUMENTS

| | | | |
|---|---|---|---|
| EP | 659396 | A1 | 6/1995 |
| EP | 659397 | A1 | 6/1995 |
| EP | 1396207 | A1 | 3/2004 |
| EP | 1515628 | A1 | 3/2005 |
| EP | 1515629 | A1 | 3/2005 |
| EP | 1516554 | A1 | 3/2005 |
| EP | 1652445 | * | 5/2006 |
| EP | 2944218 | A1 | 11/2015 |
| FR | 2967017 | A1 | 5/2012 |
| FR | 3004080 | A1 | 10/2014 |
| FR | 3020930 | A1 | 11/2015 |
| JP | 2000157322 | A | 6/2000 |
| WO | 2004002262 | A1 | 1/2004 |
| WO | 2004002263 | A1 | 1/2004 |
| WO | 2014064660 | A1 | 5/2014 |
| WO | 2015173507 | A1 | 11/2015 |
| WO | 2016001583 | A1 | 1/2016 |
| WO | 2017017158 | A1 | 2/2017 |

* cited by examiner

HAIR TREATMENT APPARATUS WITH STEAM CONTAINMENT

CROSS-REFERENCE TO RELATED APPLICATIONS

The present application is a national phase entry under 35 U.S.C § 371 of International Application No. PCT/EP2018/086738 filed Dec. 21, 2018, which claims priority from French Application No. 1763177 filed Dec. 22, 2017, all of which are hereby incorporated herein by reference.

TECHNICAL FIELD OF THE INVENTION

This invention concerns a hair treatment apparatus.

STATE OF THE PRIOR ART

It is known to smooth hair with straightening clamps. These clamps allow hair fibers to be smoothed at high temperature without pulling on the hair, unlike brushing. However, in order to obtain a good smooth appearance, it is necessary to make several passes of the clamp, which considerably lengthens the treatment time. Furthermore, the repeated application of the straightening clamp can sometimes cause the degradation of the hair fibers, due to the temperature to which the hair is exposed.

It is known to use steam for the treatment of hair, for example, associated with a treatment with hot plates, the steam being sprayed or diffused on the hair. Such a method can be implemented by a hair treatment device and/or be associated with different cosmetic hair treatments. Examples include documents EP 659 395, EP 659 393, EP 659 396, EP 659 397, US 2004/0000319, US 2004/0045570, JP 2000157322, EP1396207, EPI515628, EPI515629, EPI516554, FR 2967017 and WO 2004/002262.

The international application WO 2014/064660 describes a device to apply a cosmetic product to the hair, to steam it, to subject it to thermal treatment and to comb it.

The international application WO2017017158 also makes known a process of hair treatment involving combing of hair fibers, the application of a composition on the hair fibers, the application of steam and a thermal treatment of the hair fibers by conduction and/or radiation with the help of hot plates.

Finally, publications FR3020930 and WO 2015/173507 also make known a hairdressing device comprising a portable treatment unit with two arms configured to form a clamp with two heated contact surfaces, defined by plates arranged facing each other, which concurrently allow the clamping of a lock of hair.

This treatment unit includes steam-diffusion devices configured to diffuse steam from one of the two surfaces to the second. One of the arms includes a comb arranged downstream or upstream of one of the contact surfaces.

The devices of the previous art do not give complete satisfaction especially from the point of view of the results obtained on the hair fibers, for example in terms of volume and hold. The use of these devices also showed that the steam outlet holes can become blocked, in particular because of the different elements that may be present on the user's hair, thus decreasing the performance of these devices.

There is therefore a need to develop a new hair treatment device that is easy to use and efficient, especially that produces a satisfactory result from the first passage on the hair.

PRESENTATION OF THE INVENTION

The invention aims to meet this need and it achieves it by means of a hair treatment device comprising:

- two arms that are movable relative to each other and capable of assuming a spaced-apart configuration in which a lock of hair can be inserted between them, and a closed configuration for treating the lock of hair, the arms being capable of being moved along the lock in this closed configuration,
- two contact surfaces carried respectively by the two arms, arranged opposite each other, at least one of the contact surfaces being heated,
- at least one steam outlet carried by one of the arms at a distance from the corresponding contact surface, in order to expose the hair engaged between the arms to steam,
- containment structure for at least partially containing the steam, carried at least partially by the other of said arms, the containment structure preferably presenting at least one recess located in relation to at least one steam outlet.

Advantageously, the containment structure allows for at least partial containment of steam, outside the contact surfaces, i.e. the exterior of the contact surfaces.

The term "hair" includes the corresponding human or animal keratin fibers, as well as synthetic fibers called "extensions" that are sometimes attached to the natural hair of a person by various means, in particular by bonding, in order, for example, to modify the appearance of a person's natural hair.

A "contact surface" means a hair treatment surface, preferably a straightening surface, for example, consisting of an advantageously heated straightening plate, as will be detailed later. Each treatment surface is intended to be in contact with at least one lock of hair when treating the hair.

"Containment structure" means, as indicated above, at least one part or set of parts which allows at least partial confinement of the steam generated by said at least one steam outlet.

By "recess" we mean, advantageously, a hollow zone that runs along the steam outlet and which is intended to accumulate, contain or at least partially confine the steam. It can be extended longitudinally. Preferably, the recess has a concave shape defining a volume within which steam can be accumulated. It can advantageously form a groove. In this case, the axis of the groove belonging to the mid-plane of the groove, can be parallel or even merge with an axis of the steam outlet or make a non-zero angle, for example equal to 45 degrees or less, with the axis of the steam outlet. The recess can be delimited by one part or by several parts, including a U-shaped hollow in cross section.

The confinement, at least partial, obtained according to the invention allows for locally accumulating more steam, advantageously outside the contract surfaces, in the volume located between said at least one steam outlet and the containment structure, which can lead to a reduction in the flow of steam necessary for treating the hair. You can, due to the decrease in the amount of steam needed for treatment, extend the autonomy of the device and decrease the amount of residual moisture from the hair leaving the device. In addition, the containment structure can contribute to a better distribution of the steam longitudinally between the steam outlets. The lock of hair can thus be treated more evenly in the transverse direction.

Furthermore, the partitioning created by the containment structure allows for applying most of the steam only locally, during the passage of the lock of hair in the zone situated between the said at least one steam outlet and the groove, the zone can thus be described as the steam application zone.

The fact that at least one steam outlet is located at a distance, in other words separate from the adjacent contact surface and not within it as in the prior art, does not lead to the application of steam to the area of hair between the contact surfaces. The thermal treatment generated by the contact surfaces is thus dissociated from the application of steam from said at least one steam outlet.

The device according to the invention can be autonomous, with an integrated water tank, or include a handpiece which is formed by the arms and a base station to which the handpiece is connected, which comprises a tank containing the water for steam production.

The device preferably has a comb with teeth, carried by one of the said arms. In this case, at least one steam outlet can be interspersed between the comb and the contact surfaces. The comb can thus contribute to the containment of the steam. Also, in this case, the containment structure has an advantageous casing for the comb. Such casing can cover only one side of the teeth of the comb. Alternatively, the casing covers both sides of the teeth of the comb in the direction of passage of the hair. Alternatively, the casing covers only the tops of the teeth. One advantage of casing is that it can contribute to steam containment. Another advantage is that it forces the lock of hair to be penetrated, as it passes, between the teeth of the comb, which improves the efficiency of hair combing. The lock of hair is then untangled first during the straightening process and the hair fibers are neatly ordered before undergoing steam treatment, which improves the efficiency of the latter. Then, the strand of hair passes between the contact surfaces that are kept closed in order to apply pressure on the latter and complete the straightening process. According to this preferential arrangement, the device is perfectly ambidextrous.

The aforementioned groove and the casing of the comb can be separated, on the containment structure, by a rib arranged parallel to the groove. This rib can be formed by a portion of a part that otherwise defines the casing and the groove, this part being made of a single holding by molding material for example. Such a rib helps to limit the risk of contact between the back of the groove and the lock of hair For example, the containment structure is located near the contact surface, preferably of the plate, carried by the same arm. The containment structure can be attached to the plate, in other words on the contact surface, or on the contrary be independent of the plate, for example slightly adjustable, which allows the plate to keep certain degrees of mobility, for example to be able to rotate on itself.

Preferably, one of the arms carries one of the contact surfaces, said at least one steam outlet and possibly the comb, while the other arm carries the other contact surfaces, the containment structure and possibly the casing of the comb.

Preferably, the steam outlet or outlets are set back from a plane defined by the edge of the contact area between the contact surfaces (in the absence of hair) on the side of the steam outlet or the base of the teeth of the comb. This prevents the hair from coming into contact with the steam nozzles and thus reduces the risk of dirt or clogging. In addition, the contact surface closure plan is located above the bottom of the comb in the closed position of the device, which avoids the detachment of the hair from the head at the beginning of hair treatment, known as the "cushion effect."

Thus, thanks to this particular arrangement, the hair can be properly tensioned straight between the comb and the contact surfaces.

The containment structure is preferentially located at least partially, if not completely, behind a plane connecting the edge of the contact area between the contact surfaces on the side of the containment structure and the top of the comb when the arms are in closed configuration, which limits the risk of contact between the containment structure and the lock of hair.

The containment structure may consist of a single part or several parts assembled together and made, for example, by molding in thermoplastic material, for example PBT, or in thermoplastic elastomer material such as TPE.

The groove may have a width, measured perpendicular to the longitudinal axis of contact surfaces, preferentially plates, and parallel to the heating surfaces in close configuration of the arms, between 1 and 20 mm, preferably between 2 and 12 mm and advantageously roughly equal to 4 mm. The groove can have a depth of between 1 mm and 15 mm, preferably between 2 and 5 mm, and advantageously roughly equal to 2.5 mm. The groove does not have its own heating methods, such as electrical resistance. The temperature of the surface at the bottom of the groove is preferably almost exclusively from the heating of this surface caused by the projection of steam. The edges of the groove do not, preferably, come into contact with a surface of the opposite arm bearing at least one steam outlet.

The cumulative steam flow rate for (all of) the steam outlet(s) is preferably between 0.5 and 1.1 g/min, being preferably less than or equal to 3.5 g/min, and, better still, less than or equal to 1 g/min, for example, between 0.7 g/min and 0.9 g/min.

The steam outlet(s) is/are preferably supplied with steam by a steaming chamber which is itself supplied with water by a pump.

Said at least one steam outlet advantageously comprises at least one steam ejection channel and at least one steam ejection nozzle. This channel can be oriented perpendicular to the longitudinal axis of the corresponding arm. The nozzle can have the same orientation; thus, the steam is emitted in a direction perpendicular to the contact surfaces, and preferentially the plates, that is to say, in a direction perpendicular to the direction of travel of the lock of hair in the device.

Preferably, the nozzle(s) is/are of conical shape with a circular section, and the section of the nozzles widen in the direction of the outlet of the nozzles.

The said at least one steam outlet can have between 3 and 10 steam injection nozzles, preferably 7 nozzles. The maximum width of a nozzle, for example, is between 2 mm and 8 mm and is roughly equal to 5.3 mm. The height of a nozzle is, for example, between 2 and 10 mm, preferably between 3 and 6 mm, advantageously roughly equal to 3.5 mm. The distance between two adjacent nozzles, measured between the axes thereof, can be between 5 and 20 mm and advantageously roughly equal to 11 mm.

The groove is at a distance from the upper end of the steam injection nozzle or nozzles, this distance being for example between 3 and 20 mm, preferably between 5 and 10 mm, when measured by the longitudinal axis of the arm in a closed position.

The steam is preferably water steam, in particular without additives.

Each steam ejection nozzle is preferably mounted at one end of each steam ejection channel. Each channel has a width, for example, between 0.2 and 5 mm, advantageously roughly equal to 1.6 mm. Each channel has a height, for example, between 1 and 15 mm, advantageously roughly equal to 5 mm.

The nozzles can be identical to each other. The channels can be identical to each other.

The device may not include a reservoir for a cosmetic composition, nor an applicator for a cosmetic composition.

However, the invention does not exclude such a composition application by the device, for example with an applicator carried by one of the arms, or an application prior to the treatment by the device or after it.

BRIEF DESCRIPTION OF THE FIGURES

The invention will be better understood on reading the detailed description which follows, of non-limiting examples of implementation thereof, and on examining the appended drawing, in which.

DETAILED DESCRIPTION OF THE EMBODIMENTS

In the following description, identical elements or identical functions bear the same reference sign. Their description is not repeated in relation to each of the figures, and only the main differences between the embodiments are mentioned.

Figure 1:
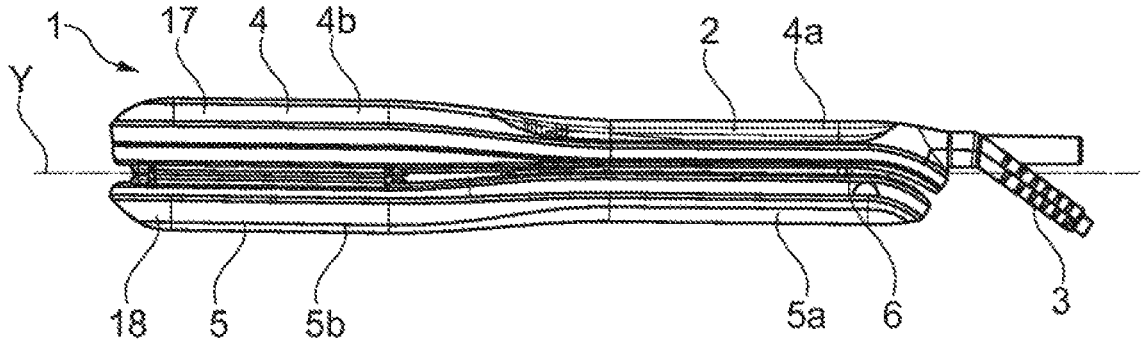
FIG. 1 shows schematically, in side perspective, a processing example of device of the hair according to the invention, FIG. 2 schematically represents, seen in perspective from the other side, the device of FIG. 1, the device having been turned over, FIG. 3 schematically represents, in frontal perspective, the device of FIG. 1.

FIG. 1 shows a device 1 for treating the hair, in accordance with an initial exemplary embodiment according to the invention.

In the example illustrated, the device 1 is autonomous, with an integrated water tank 2. Only part of the electrical supply cord 3 is visible in FIGS. 1 and 2.

Figure 2:
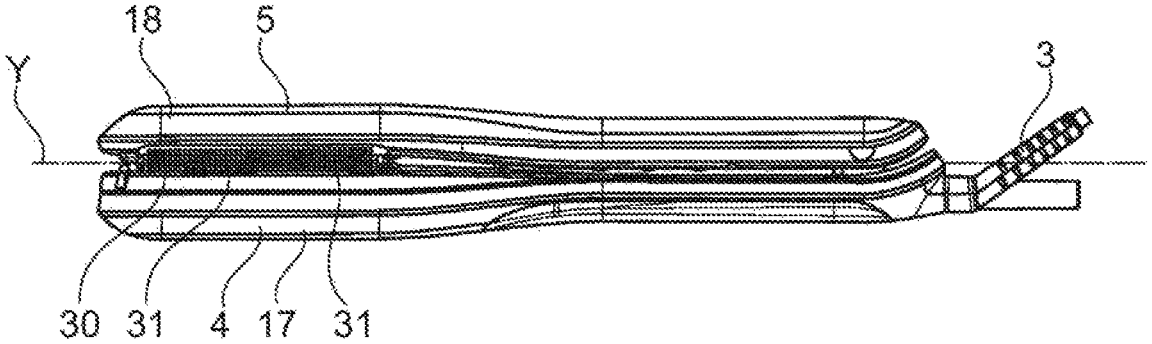
Figure 3:
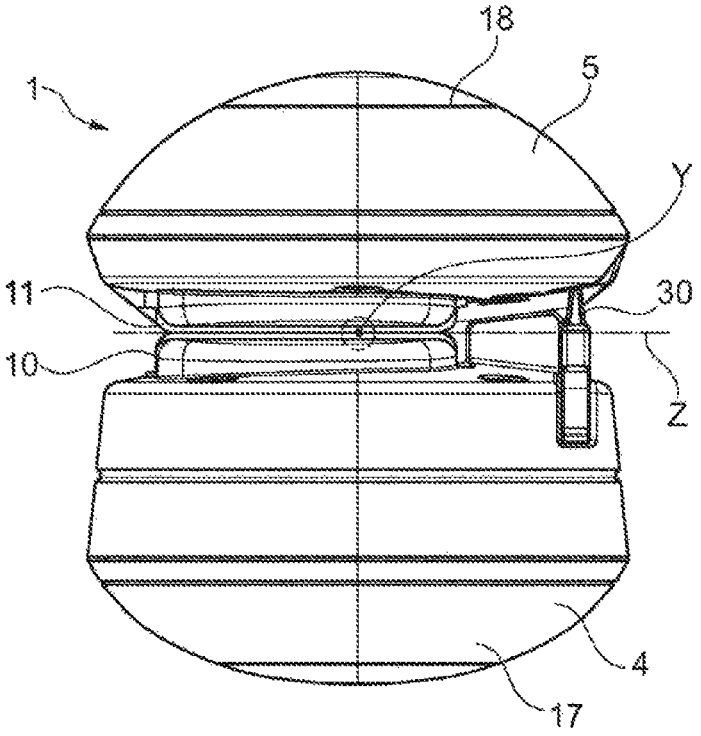
Figure 10:
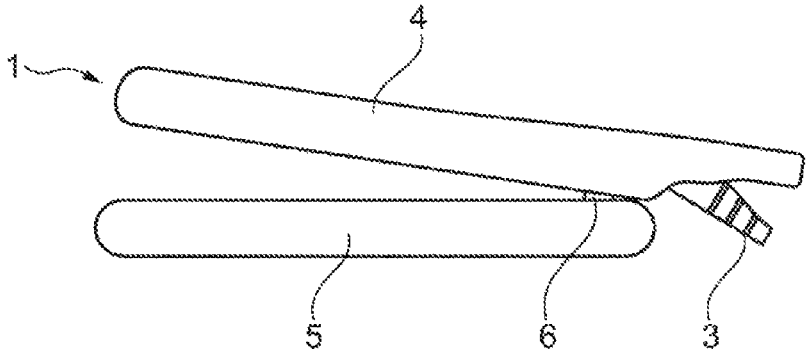
FIG. 10 is a schematic and partial side view of another example of a device according to the invention, FIG. 11 schematically illustrates, in cross-section, a variant of device consistent with the invention.

The device 1 comprises two arms 4 and 5 extending along a longitudinal axis Y, movable relative to each other, which can assume a configuration where they are apart for the introduction of a lock of hair between them and a configuration where they are closed for treatment of the lock of hair. FIGS. 1, 2, and 3 in particular illustrate this latter configuration. FIG. 10 represents, the configuration separated from the arms 4 and 5, for introducing a lock of hair between them.

The arms 4 and 5 are hinged together by means of a pivot link 6 so as to form a clamp. The cases of arms 4 and 5 have shells 17 and 18 respectively, which house different components of the device. The arms 4 and 5 are movable in the close configuration along the lock of hair to be treated and comprise respective proximal parts 4*a* and 5*a*, which can be concomitantly grasped with one hand to manipulate the device 1.

The arms 4 and 5 also comprise respective distal parts 4*b* and 5*b*, equipped with opposite corresponding plates 10 and 11, and which allow the hair to be pinched between them.

Plates 10 and 11 define contact surfaces 13 and 12 respectively.

In the example illustrated, the contact surfaces 12 and 13 are substantially planar.

Plate 11 is heated by at least one resistive heating element 15, housed in a case 22 of the arm 5, not far from the contact surface 12. As a variant, the plates 10 and 11 are each heated by a separate heating device, in which case another resistive heating element is mounted in the case 23, for example.

It should be noted that variants are possible for the shape of contact surfaces 12 and 13. One can, for example, implement curved surfaces, as on certain hairdressing devices allowing the curling of the hair, or even make it wavy, like those used in hair crimpers, or even equipped with many protuberances, such as teeth for example.

The device 1 comprises at least one steam outlet 20, in this case several outlets, carried by the arm 4, at a distance from the plate 10, to expose the hair engaged between the arms 4 and 5 when they are in this steam application zone.

In accordance with the invention, a containment structure 21 allows at least partial containment of the steam emitted by the device. This containment structure 21 is carried by arm 5. In this example, it has a recess formed by a groove 25 in front of the steam outlets 20.

In the example illustrated, there are 7 steam outlets 20, but the invention is not limited to a particular number of outlets. These are located at a distance from plate 10 and not within this plate. This helps to not apply steam to the portion of the hair positioned between plates 10 and 11 at a given moment, and also protects the steam outlets from any risk of getting clogged or blocked by elements that could be on the hair, such as leftover cosmetics or dandruff. The thermal treatment generated by plates 10 and 11 is thus dissociated from the application of steam by the outlets 20.

Figure 7:
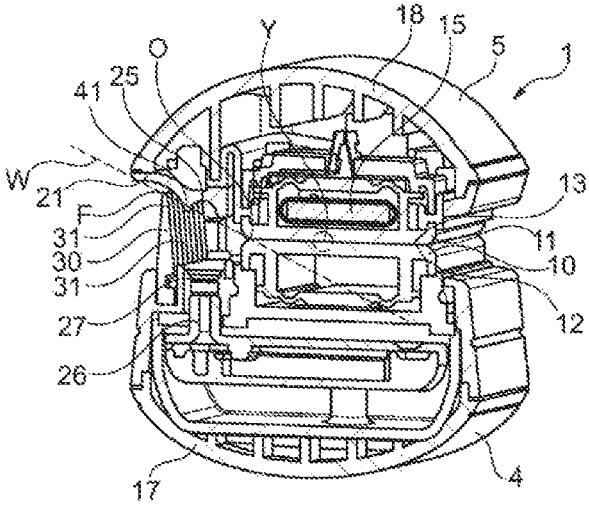
FIG. 7 is a schematic cross section and in perspective of the device of FIG. 1.

Arm 4 also features a comb 30 that in the illustrated example presents a single row of teeth 31, visible on FIGS. 2 and 7 in particular. The comb may include rigid teeth and/or flexible bristles such as, for example, silk tufts of bristles.

Figure 4A:
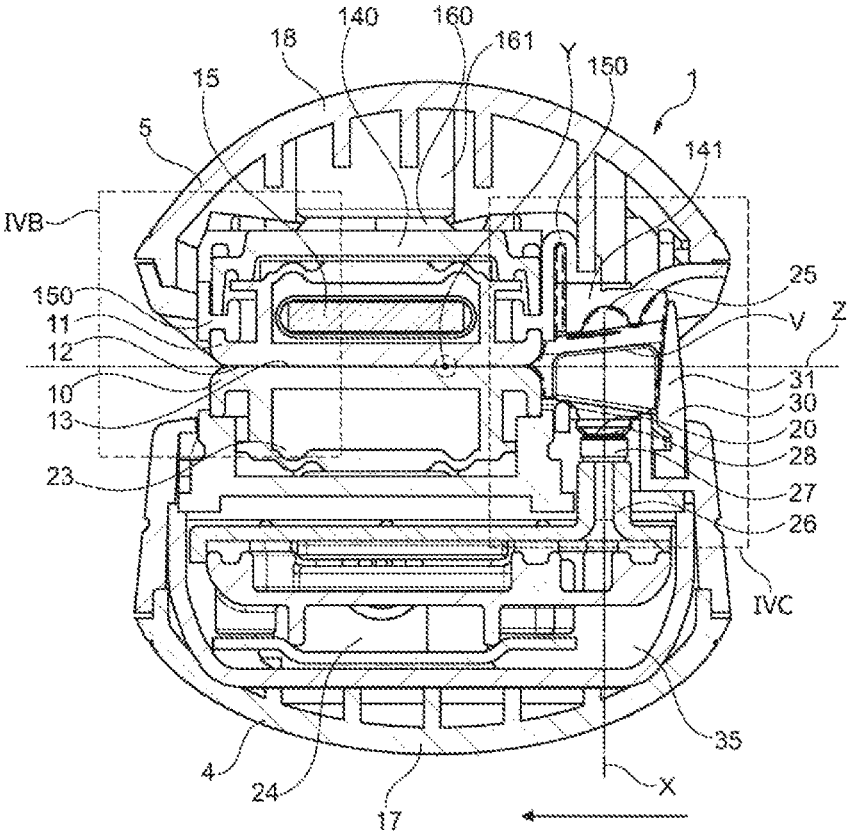
FIG. 4A is a schematic view, in cross section, of the device of FIG. 1, FIGS. 4B and 4C are enlarged views according to IVB and IVC in FIG. 4A.
Figure 4B:
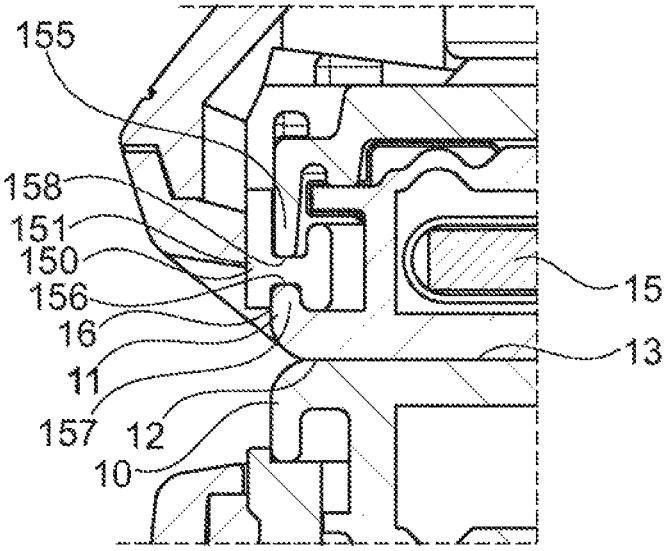
Figure 4C:
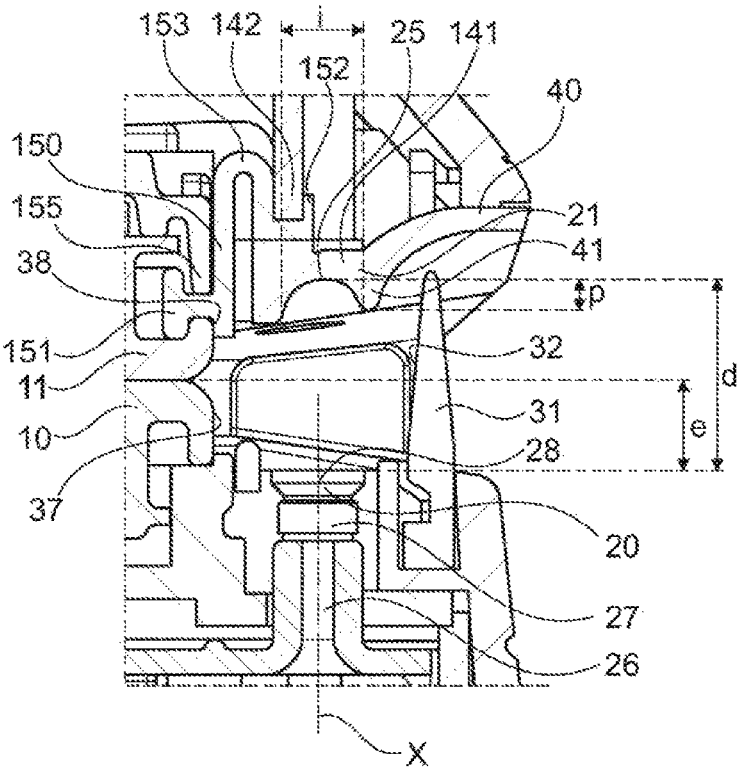

Each steam outlet 20 has a channel 26 extending on an X axis visible on FIGS. 4A and 4C, topped by a nozzle 27, the X axis being that of the steam outlet. Each nozzle 27 has a shape flaring outward. This allows the steam to be diffused evenly throughout the containment zone and to continuously renew the steam that escapes from the containment zone, notably through the front and/or back of the device.

The groove 25 is centered on the X-axis, which means that in the cross section, the axis of the groove is mixed up with the X-axis of the steam outlet. The bottom of the groove is at a distance d from the upper end 28 of the nozzles 27 equal to about 8.5 mm in this example, when arms 4 and 5 are in closed position. The groove 25 does not have its own heating system.

Figure 6:
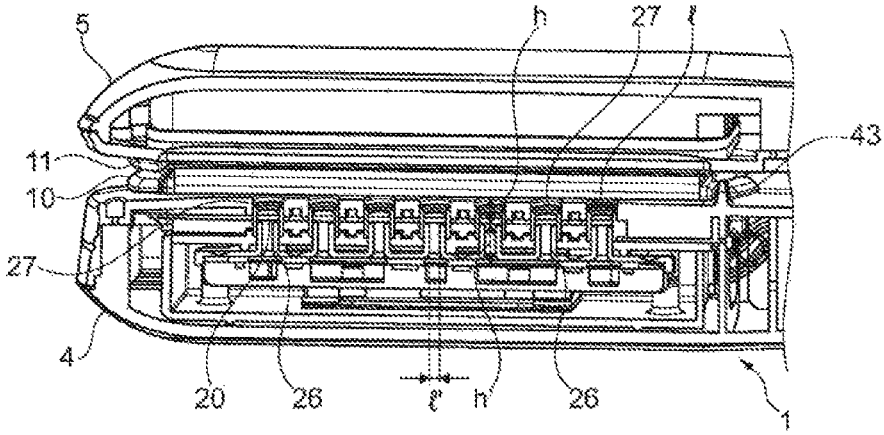
FIG. 6 is a longitudinal section, partial and schematic, of the device of FIG. 1.

As is visible in FIG. 6, each nozzle 27 has, for example, a height h of 2.8 mm and a width/maximum, at its upper end, of 3.4 mm Each channel 26, for example, has a height h' of 4.8 mm and a width l', corresponding to an interior diameter of 1.6 mm.

The lower part of the arm 4 houses the steaming chamber which allows the creation of steam which is then projected through the outlets 20 passing through the channels 26 and nozzles 27.

Such a steaming chamber may include a heating device consisting for example of a thermistor with a positive temperature coefficient, called PTC, and a device for measuring the temperature of the heating device consisting for example of a thermistor with a negative temperature coefficient, called NTC. These heating and measuring devices are arranged in housing 24 visible on FIGS. 4 and 7, under housing 23.

The total steam flow delivered by all the steam outlets can be between 0.5 g/min and 0.8 g/min.

The steam outlets 20 receive a steam supply through a steaming chamber, which may be supplied by means of a pump and, in particular, of a peristaltic pump, itself connected to the reservoir 2, these elements preferably being located in the same arm 4.

In this example, as is visible in FIGS. 4A to 4C, the arm 5 comprises at least a first part 140 for supporting the plate 11 and at least one second part 141 distinct from the first and separated from the latter. The device 1 also comprises an elastically deformable sealing element 150, comprising a proximal portion 151 extending at least partially around the plate 11 between the latter and the first part 140 and a distal portion 152 extending in contact with the second part 141, the proximal 151 and distal 152 portions being connected by an intermediate portion 153, flexible, extending between the first and second parts 140 and 141. The proximal portion 151 extends over the entire periphery of the plate 11. As can be seen more specifically in FIG. 4B, the proximal portion 151 of the sealing element 150 is pinched between the plate 11 and a rib 155 of the first part 140. In this example, the proximal portion 151 has a generally H-shaped cross section. The proximal portion 151 has a groove 156 engaged in a return 157 of the plate 11 and an opposite groove 158, engaged in the rib 155 of the first part 140.

The distal portion 152 is pinched between the second part 141 and a third part 142 of the arm 5, formed in this example by shell 18.

The intermediate portion 153 has at least one bend in cross section. In the example illustrated, the intermediate portion 153 is curved concave towards the opposite arm 4, with a U-shaped bottom in cross section. Intermediate portion 153 then has a bellows-like shape, such as an accordion bellows that gives the intermediate portion 153 of the sealing element 150 great flexibility, advantageously to be able to follow the movement of plate 11 as described below while guaranteeing the seal around plate 11.

The plate 11 has a generally rectangular outline with four sides. The intermediate portion 153 and the distal portion 152 extend around three of the four sides of the plate 11 only. The intermediate portion 153 and the distal portion 152 are absent from the side 16 of the plate 11 furthest from said at least one steam outlet 20. Thus, we can see in FIG. 4A or 4B that the sealing element 150 only contains the proximal part 151 on the said 16 of plate 11, which is opposite to the steam outlet 20. On the other three sides of plate 11 the proximal part 151 is extended by the intermediate part 153 of the sealing element 150, as visible in particular on FIG. 4A or 4C. Limiting the sealing element 150 forming a joint on the only proximal part 151 on the side 16 of the plate reduces the width of the device 1 without significantly impairing the seal.

Figure 12:
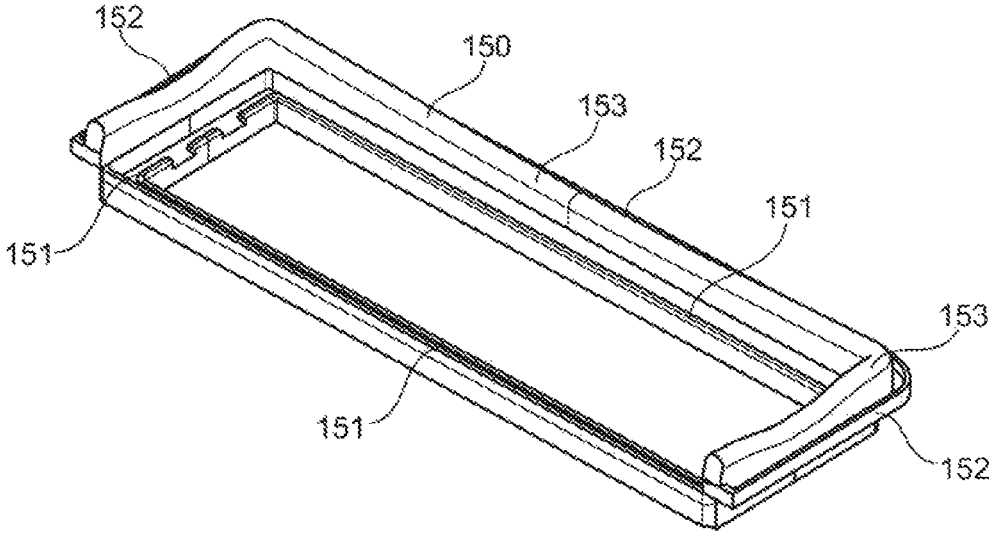
FIG. 12 is an isolated, schematic, and perspective view of the sealing element of the device of FIG. 1.

The sealing element 150, as can be seen in particular in isolation in FIG. 12, has a non-symmetrical shape, with respect to a median plane passing through the plate 11 parallel to the longitudinal axis Y of the device 1 and perpendicular to a heating surface 12 of the plate 11 facing the plate 10.

According to this example, the proximal portion 151 of the sealing element 150 was mounted on the entire periphery of plate 11, by being interspersed between plate 11 and the first part 140 of the plate support. In other words, the peripheral edge of plate 11 is isolated from the first part 140 of the plate support by the sealing element 150, which ensures that the joint is sealed.

Still in this example, the sealing element 150 is present on a single arm, namely the arm 5, said at least one steam outlet 20 being carried by the other arm, namely the arm 4. Plate 11 is, in the example illustrated in FIG. 4A, mounted on a swivel on the corresponding arm via the engagement of a head 160 in the shape of a sphere portion, said head 160 being interdependent on the first part 140 of the plate 11 support. The sphere portion is then mounted in a housing defined by a cylindrical wall 161 formed with the shell 18 of arm 5.

The support of the spherical surface of the head 160 on the circular edge of the wall 161 creates a ball joint, which allows the plate 11 to pivot when the thickness of the lock of hair which is pinched between the plates is not homogeneous, and thus with a greater contact surface with the lock. The deformability of the sealing element 150 thanks to the intermediate portion 153 allows it to accompany this pivoting of the plate 11 while playing a role of barrier against the steam.

The device 1 may also include an electronic card, not illustrated, configured to manage the electrical supply of the resistive heating elements in order to control the operating temperature. This electronic card can be arranged inside one of the two arms 4 or 5, for example in the proximal part 4*a* of the arm 4, and have a user interface.

The device 1 may further comprise a magnetic sensor, not illustrated, of the ILS flexible blade switch type, which allows to detect the close configuration of the arms 4 and 5, in which the surfaces 12 and 13 are substantially one against the other to grab the lock of hair to be treated. In another variant, the flexible blade switch is replaced by a magnetoresistive sensor MRS, or by any other detection means.

Figure 5:
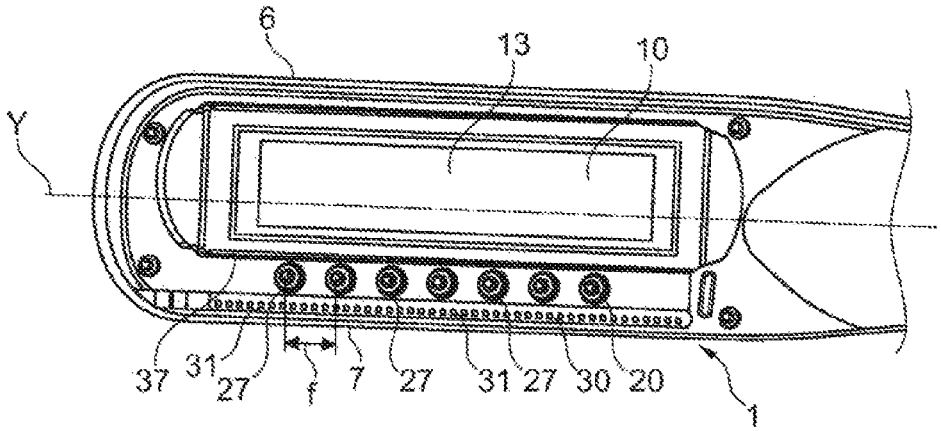
FIG. 5 is a schematic and partial top view of the inner part of the arms of the device in FIG. 1.

Steam outlets 20 are organized in the example considered in a row, the latter parallel to the longitudinal Y-axis and a lateral edge 37 of the hot plate 10 and the tooth row 31 of the comb 30, as visible on FIG. 7. The row of steam outlets is arranged between comb 30 and lateral edge 37 of plate 10. The distance/between two adjacent nozzles 27, measured between the axes of these as visible in FIG. 5, is for example equal to 9.7 mm.

Figure 9:
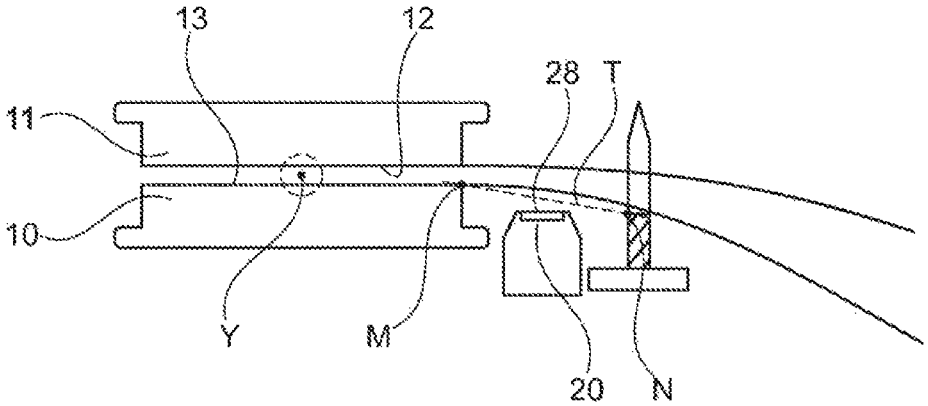
FIG. 9 is a schematic and partial cross section of another example of device according to the invention.

As can be seen in FIGS. 4A and 4C in particular, the upper end 28 of each steam outlet 20 is set back from the plane (Y, Z) defined by the surface 13, the distance e between the latter and the plane (Y, Z) being equal to, for example, 4.6 mm. The upper end 28 of each steam outlet 20 is also set back from the T-plane connecting the end M of surface 13 and the base N of the comb teeth, as visible in FIG. 9.

The containment structure 21 has, in addition to the groove 25, a casing 40 for the comb, separated from the groove 25 by a rib 41. The latter is parallel to the longitudinal Y axis. The containment structure 21 consists of a single part molded in thermoplastic material, in the illustrated example. One does not go beyond the scope of the inspection when containment structure 21 is made from several parts assembled together.

The containment structure 21 is located largely behind a plane W illustrated in dotted line on FIG. 7, connecting the edge O of the contact area between plates 10 and 11 in close configuration of arms 4 and 5, and the top of the comb 31 corresponding to the right F joining the ends of the comb teeth. The rib 41, in this example, slightly sticks out under the plane W.

The fastening of the containment structure 21 on the associated arm can be carried out in a variety of ways. In the illustrated example, the part that defines containment structure 21 is joined and attached to the shell 18 by any means of assembly known as such, such as screwing, bonding, welding or clicking.

The groove 25 has a concave cross section, particularly significantly semi-circular, of width i measured perpendicular to the longitudinal Y-axis of plates 10 and 11 and parallel to surfaces 12 and 13 in close configuration of arms 4 and 5, for example equal to 3.5 mm and with depth p for example equal to 1.8 mm, but the invention is not limited to a particular section form, and U, V or semi-elliptic sections are possible. In the example illustrated, the groove 25 has no symmetrical edges compared to a plane parallel to the X-axis.

In this example, the casing 40, in close configuration of the arms, covers only one part of the inside 32 of the teeth 31 of the comb 30, in other words the one facing plate 11.

Figure 8:
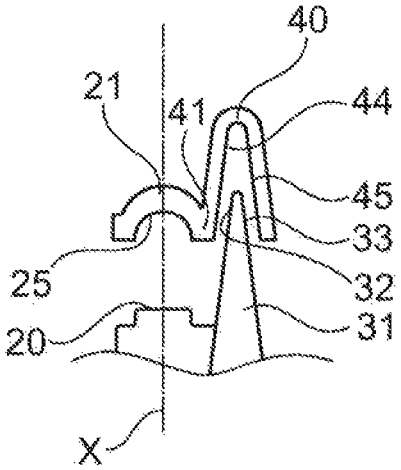
FIG. 8 is a cross section, schematic and partial, of another example of device according to the invention.

In the variant shown in FIG. 8, the casing 40 of the comb 30 covers part of the inner 32 and the outer sides 33 of the teeth 31. The casing 40 can feature significantly parallel walls 44 and 45 respectively at the sides 32 and 33 of the teeth 31, at a distance from these and shifted upwards according to the X-axis. In this case, as visible on this figure, only the top of the teeth 31 is covered by the casing 40.

The containment provided by the casing 40 does not prevent steam from escaping through the teeth 31 of the comb 30 and through the space above the upper edge of the teeth 31 under the casing 40. However, the latter may act, with respect to steam release, as an additional obstacle that contributes to the containment of steam upstream of plates 10 and 11.

FIG. 4A shows in dotted lines the volume V in which steam is mainly confined, this volume being delimited on the inside by the lateral edges 37 and 38 of plates 10 and 11, on the outside by the teeth 31 of the comb, and at the top by the groove 25, rib 41 and casing 40. The sealing element 150 also helps to delineate this volume and to confine the steam. This volume V can be between 2,000 and 10,000 $mm^3$ being, for example, close to 5,500 $mm^3$. In other words, a volume V of steam is therefore confined between the comb 30, the containment structure 21, the plates 10, 11, and the steam outlets 20.

As can be seen in FIG. 6 in particular, at least one steam barrier 43 can be placed on arm 4 at the end of the steam outlet row 20, proximal part side 4*a*, so as to confine steam to that side.

It should be noted that plates 10 and 11 are not centered on device 1 but shifted to a lateral edge 6 of the device 1, while the comb 30 adjoins the latter in parallel with the other lateral edge 7 of the device 1. The row of steam outlets 20 extends between the comb and plates 10 and 11, parallel to these and the longitudinal Y-axis.

When using the device 1, the treated lock of hair follows the direction shown in FIG. 4A relative to the device 1, taking into account the movement of the device along the lock. First of all, a given area of hair makes contact with the teeth 31. Given the shape of the casing, the hair is forced by it to pass between the teeth 31 of the comb 30. The aforementioned area of the lock then arrives in volume V where steam can accumulate, and it is exposed to the steam emitted by the steam outlets 20. Finally, the area in question is pinched between heating surfaces 12 and 13, where it undergoes heat treatment without steam. With such a configuration, we obtain satisfying hair straightening from the first pass. Reducing the flow of steam allowed by containment, preferably at less than 3.5 g/min, allows for less residual moisture at the finish between the plates and for achieving good results.

The invention is not limited to the examples that have just been described.

For example, the device may have a hair product applicator, for example located at the edge of the contact area between the plates or before the comb, or interspersed between the comb and the steam containment area, or between the steam and the plates.

The containment structure can be modified. For example, the groove 25 can be given another shape or orientation.

If necessary, the rib that separates the groove from the casing in the example of FIG. 8 is removed.

Figure 11:
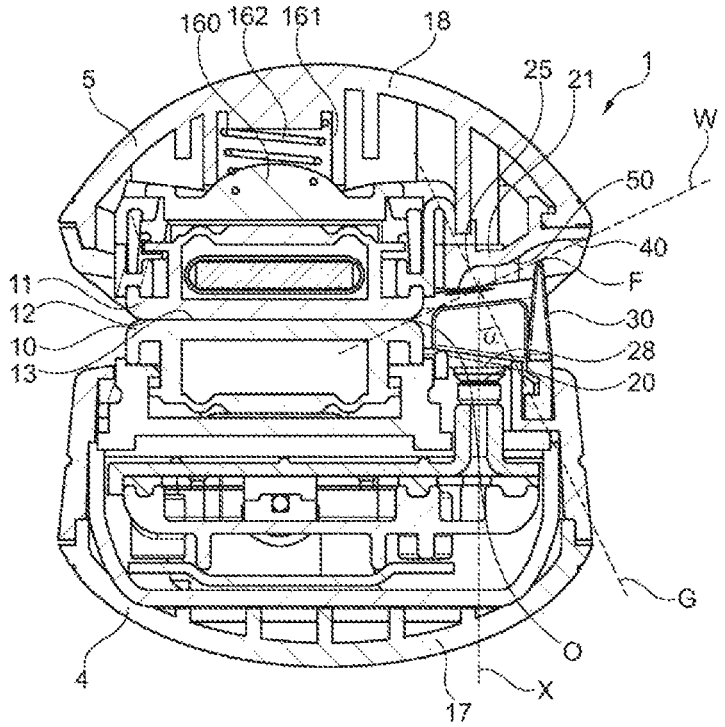

In the embodiment illustrated in FIG. 11, there is no rib between the groove and the casing but a convex zone 50 separating the concave parts that form the groove 25 and the casing 40. The groove 25 is not a cavity that is significantly closed sideways to the casing 40. Moreover, groove 25 presents, in this example, a cross-sectional G axis passing through the bottom of the groove, the said G axis forming a non-zero angle, equal in this example to 45 degrees with the X axis of the steam outlet. The G axis is oriented in such a way that groove 25 is usually turned towards the comb, as visible on the figure. Such an arrangement makes it advantageous to direct the containment of steam towards the comb 30 and away from plates 10, 11.

Furthermore, in this FIG. 11, we can see a helical spring 162 which is supported at one end against the bottom of the case defined by the cylindrical wall 161 and at the other end against the head 160. In this figure, the containment structure 21 is located behind the W plane connecting the edge of the contact area between plates 10 and 11 in close configuration of arms 4 and 5, and the top of comb 31 to avoid contact of the lock of hair with the containment structure 21 while reserving a certain volume of steam between said structure 21 and the said lock of hair.

The invention claimed is:

1. A device for treating the hair, comprising:

first and second arms movable relative to each other and configured to assume a spaced-apart configuration in which a lock of hair can be inserted between them, and a closed configuration for treating the lock of hair, the first and second arms configured to move along the lock in the closed configuration;

first and second contact surfaces carried respectively by first and second contact plates on the first and second arms, respectively, arranged opposite each other, at least one of the first and second contact surfaces configured to be heated;

at least one steam outlet carried by one of the first and second arms spaced from the corresponding contact plate, to steam the hair engaged between the first and second arms;

a comb with teeth carried by said one of the first and second arms which carries said at least one steam outlet;

a containment structure, allowing at least partial containment of the steam, carried at least in part by the other of said first and second arms, the containment structure including at least one recess aligned with and opposite said at least one steam outlet, and a convex rib adjacent the at least one recess;

wherein the at least one steam outlet is configured to be interspersed between the comb and the contact plates.

2. The device according to claim 1, wherein the at least one recess forms a groove.

3. The device according to claim 2, wherein the axis of the groove is parallel to an axis of the steam outlet.

4. The device according to claim 2, wherein an axis of the groove forms a non-zero angle with an axis of the steam outlet.

5. The device according to claim 2, wherein the axis of the groove is parallel to an axis of the steam outlet, and wherein the groove has a width between 1 mm and 20 mm, and a depth between 1 mm and 15 mm.

6. The device according to claim 1, wherein said at least one steam outlet is arranged behind a plane defined by the edge of the contact area between the first and second contact surfaces on the side of said at least one steam outlet and a base of the teeth of the comb.

7. The device according to claim 1, wherein the containment structure has a casing for the comb.

8. The device according to claim 7, wherein the containment structure is located at least partially behind a plane connecting an edge of a contact area between the first and second contact surfaces and a top of the comb when the first and second arms are in closed configuration.

9. The device according to claim 7, wherein the casing covers only one side of the teeth of the comb.

10. The device according to claim 7, wherein the casing covers both sides of the teeth of the comb.

11. The device according to claim 7, wherein the casing covers only one side of the teeth of the comb, and wherein the at least one recess and the casing of the comb are separated, on the containment structure, by a rib arranged parallel to the groove, and wherein the rib is positioned between the comb and the at least one recess.

12. The device according to claim 1, wherein the containment structure is located near the first or second contact surface carried by the first or second arm.

13. The device according to claim 1, wherein the containment structure includes a single part or several parts assembled together and made by molding in thermoplastic matter.

14. The device according to claim 1, wherein the cumulative steam flow rate for the at least one steam outlet is between 0.5 and 1.1 g/min.

15. The device according to claim 1, wherein said at least one steam outlet includes at least one steam ejection channel and at least one steam ejection nozzle.

16. The device according to claim 15, wherein said at least one steam outlet has between 3 and 10 steam ejection nozzles, the maximum width of a nozzle between 2 mm and 8 mm, and the height of a nozzle (between 2 and 10 mm.

17. The device according to claim 15, wherein the steam ejection nozzle is mounted at one end of the corresponding steam ejection channel, said channel with a width between 0.2 mm and 5 mm and a height between 1 mm and 15 mm.

18. The device for treating hair according to claim 1, wherein the steam outlet and the containment structure are positioned along a common axis a distance from the first and second contact plates.

19. The device for treating hair according to claim 1, wherein the first and second contact surfaces define a first plane and an upper edge of the teeth define a second plane parallel to the first plane, and in the closed configuration the rib extends beyond the second plane toward the at least one steam outlet such that the rib contributes to containment of steam.

20. The device for treating hair according to claim 1 further comprising a sealing element including a flexible portion extending along a side nearest the at least one steam outlet of said one of the first and second arms which carries the containment structure.

* * * * *